US007384338B2

(12) United States Patent
Rothschild et al.

(10) Patent No.: US 7,384,338 B2
(45) Date of Patent: Jun. 10, 2008

(54) GAMING SYSTEM HAVING PLAYER-PROFILE INPUT FEATURE FOR MAINTAINING PLAYER ANONYMITY

(75) Inventors: Wayne H. Rothschild, Northbrook, IL (US); Richard T. Schwartz, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 561 days.

(21) Appl. No.: 10/744,972

(22) Filed: Dec. 22, 2003

(65) Prior Publication Data

US 2005/0137006 A1 Jun. 23, 2005

(51) Int. Cl.
*A63F 9/24* (2006.01)

(52) U.S. Cl. ..... 463/29

(58) Field of Classification Search ..... 463/25, 463/27, 29, 20

See application file for complete search history.

(56) References Cited

U.S. PATENT DOCUMENTS

| | | | | |
|---|---|---|---|---|
| 4,856,787 | A | 8/1989 | Itkis | |
| 5,083,271 | A | 1/1992 | Thacher et al. | 364/411 |
| 5,179,517 | A | 1/1993 | Sarbin et al. | 364/410 |
| 5,242,163 | A | 9/1993 | Fulton | 273/85 |
| 5,342,047 | A | 8/1994 | Heidel et al. | 273/85 |
| 5,393,057 | A | 2/1995 | Marnell, II | 273/85 |
| 5,409,225 | A | 4/1995 | Kelly et al. | 273/138 |
| 5,564,700 | A | 10/1996 | Celona | 463/27 |
| 5,580,309 | A | 12/1996 | Piechowiak et al. | 463/16 |
| 5,611,730 | A | 3/1997 | Weiss | 463/20 |
| 5,639,088 | A | 6/1997 | Schneider et al. | 273/138.2 |
| 5,702,304 | A | 12/1997 | Acres et al. | 463/29 |
| 5,833,540 | A * | 11/1998 | Miodunski et al. | 463/42 |
| 5,848,932 | A | 12/1998 | Adams | 463/20 |
| 5,979,702 | A | 11/1999 | Hennessey et al. | 221/206 |
| 5,980,384 | A | 11/1999 | Barrie | 463/16 |
| 6,033,307 | A | 3/2000 | Vancura | 463/20 |
| 6,068,552 | A | 5/2000 | Walker et al. | 463/21 |
| 6,089,982 | A * | 7/2000 | Holch et al. | 463/42 |
| 6,110,041 | A * | 8/2000 | Walker et al. | 463/20 |
| 6,142,872 | A | 11/2000 | Walker et al. | 463/16 |
| 6,165,071 | A | 12/2000 | Weiss | 463/24 |
| 6,254,483 | B1 | 7/2001 | Acres | 463/26 |

(Continued)

FOREIGN PATENT DOCUMENTS

CA 2331238 A1 * 7/2001

*Primary Examiner*—Xuan M. Thai
*Assistant Examiner*—Jasson H Yoo
(74) *Attorney, Agent, or Firm*—Nixon Peabody, LLP.

(57) ABSTRACT

A method of operating a wagering game includes conducting a wagering game at a gaming terminal, and receiving inputs from a player that relate to a profile of the player. The inputs exclude a player's true identity. The method includes comparing the player inputs with a plurality of player-profile data sets to match the player inputs with a particular player-profile data set. In response to this comparison yielding a matched player-profile data set, the method includes activating one or more personalized attributes at the gaming terminal associated with the matched player-profile data set. The method can be practiced within a gaming system comprising a database, a controller, and at least one gaming terminal. The database stores the player-profile data sets. Each data set is associated with and maintains anonymity of a respective player. An input device at the gaming terminal receives player-profile inputs for comparison to the player-profile data sets.

48 Claims, 5 Drawing Sheets

U.S. PATENT DOCUMENTS 6,293,866 B1 9/2001 Walker et al. ..... 463/20
6,302,793 B1 * 10/2001 Fertitta et al. ..... 463/25
6,319,125 B1 11/2001 Acres ..... 463/25
6,342,010 B1 1/2002 Slifer ..... 463/29
6,350,199 B1 * 2/2002 Williams et al. ..... 463/16
6,364,765 B1 4/2002 Walker et al. ..... 463/16
6,520,856 B1 2/2003 Walker et al. ..... 463/1
6,607,441 B1 8/2003 Acres ..... 463/25
6,612,928 B1 9/2003 Bradford et al. ..... 463/29
6,652,380 B1 11/2003 Luciano ..... 463/25
6,666,768 B1 12/2003 Akers ..... 463/40
6,709,333 B1 3/2004 Bradford et al. ..... 463/29
6,712,697 B2 3/2004 Acres ..... 463/25
6,712,699 B2 3/2004 Walker et al. ..... 463/30
6,722,985 B2 4/2004 Criss-Puszkiewicz et al. ..... 463/29
6,743,098 B2 * 6/2004 Urie et al. ..... 463/29
6,769,986 B2 8/2004 Vancura ..... 463/30
6,776,715 B2 * 8/2004 Price ..... 463/27
6,846,238 B2 1/2005 Wells ..... 463/39
6,896,618 B2 5/2005 Benoy et al. ..... 463/25
6,979,264 B2 12/2005 Chatigny et al. ..... 463/29
7,001,279 B1 * 2/2006 Barber et al. ..... 463/42
7,033,276 B2 4/2006 Walker et al. ..... 463/40
7,040,987 B2 5/2006 Walker et al. ..... 463/42
2002/0111210 A1 * 8/2002 Luciano et al. ..... 463/29
2002/0111213 A1 8/2002 McEntee et al. ..... 463/42
2002/0132663 A1 * 9/2002 Cumbers ..... 463/25
2002/0142825 A1 * 10/2002 Lark et al. ..... 463/16
2002/0142844 A1 10/2002 Kerr ..... 463/42
2002/0142846 A1 * 10/2002 Paulsen ..... 463/43
2002/0151366 A1 * 10/2002 Walker et al. ..... 463/42
2002/0178163 A1 * 11/2002 Mayer ..... 707/10
2002/0184500 A1 12/2002 Maritzen et al. ..... 713/170
2003/0003988 A1 1/2003 Walker et al. ..... 463/21
2003/0078101 A1 * 4/2003 Schneider et al. ..... 463/42
2003/0092489 A1 5/2003 Veradej ..... 463/36
2003/0131265 A1 7/2003 Bhakta ..... 713/202
2003/0177120 A1 * 9/2003 Stodolsky ..... 707/9
2003/0228898 A1 12/2003 Rowe ..... 463/25
2004/0005919 A1 * 1/2004 Walker et al. ..... 463/23
2004/0009809 A1 1/2004 Salerno ..... 463/25
2004/0031845 A1 2/2004 Solomon ..... 235/375
2004/0048657 A1 3/2004 Gauselmann ..... 463/25
2004/0142747 A1 7/2004 Pryzby ..... 463/35
2004/0180712 A1 9/2004 Forman et al. ..... 463/17
2004/0192438 A1 9/2004 Wells et al. ..... 463/29
2004/0192442 A1 9/2004 Wells et al. ..... 463/36
2005/0043092 A1 2/2005 Gauselmann ..... 463/36
2005/0054438 A1 3/2005 Rothschild et al. ..... 463/29
2005/0077995 A1 4/2005 Paulsen et al. ..... 340/5.6
2005/0170890 A1 8/2005 Rowe et al. ..... 463/42
2005/0277469 A1 12/2005 Pryzby et al. ..... 463/35
2006/0040741 A1 2/2006 Griswold et al. ..... 463/40
2006/0046842 A1 3/2006 Mattice et al. ..... 463/29
2006/0076404 A1 4/2006 Frerking ..... 235/382

* cited by examiner

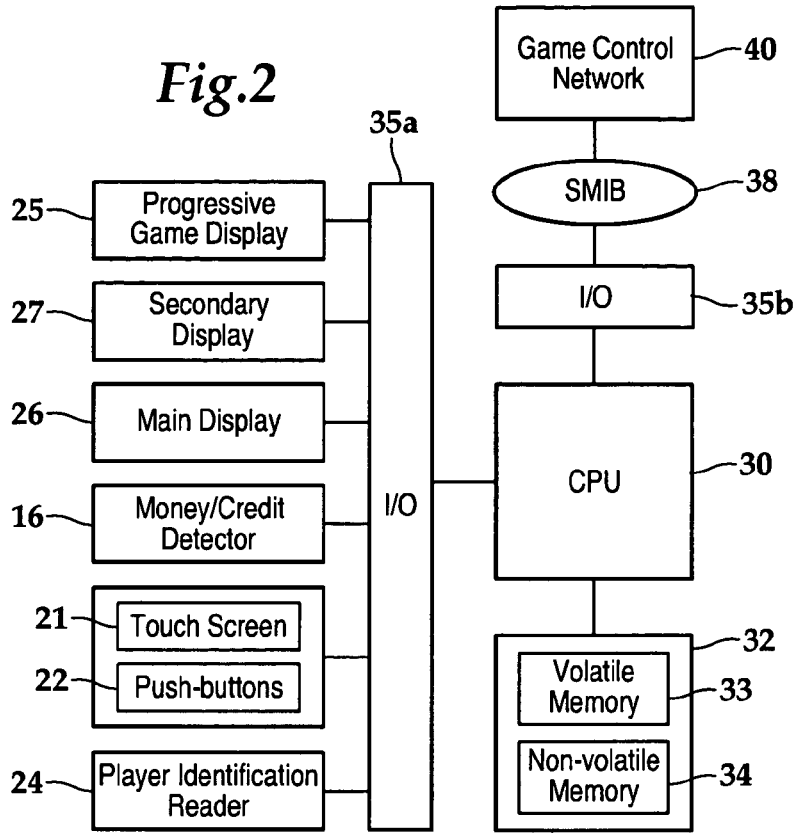
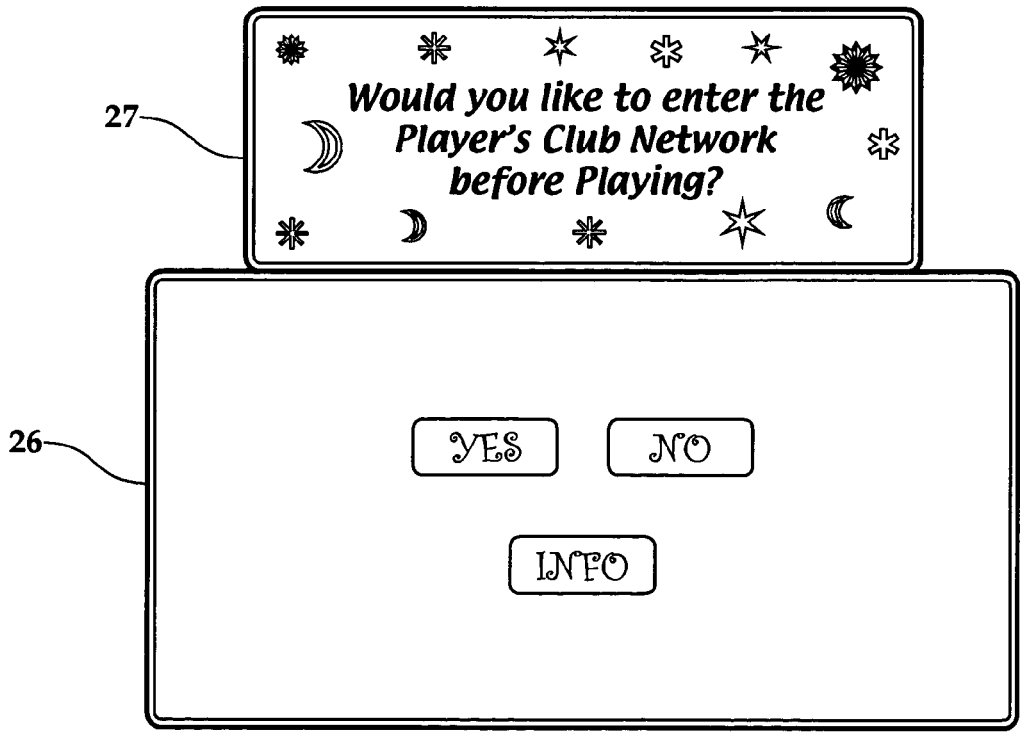
Fig.3

GAMING SYSTEM HAVING PLAYER-PROFILE INPUT FEATURE FOR MAINTAINING PLAYER ANONYMITY

FIELD OF THE INVENTION

The present invention relates generally to gaming machines and, more particularly, to a gaming terminal and a gaming network permitting players to be identified based on a player profile that allows them to remain anonymous as an option to, or a substitute for, identification based on the player's true identity.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by increasing the entertainment value and excitement associated with the game.

One concept that has been successfully employed is to reward players for loyalty in playing certain games or playing at certain casinos. Once a player has been identified, he or she may be rewarded with incentives after achieving certain levels of wagering. Typically, the player's true identity is provided to the gaming terminal in the form of a player identification card or through the player's entry of certain information at the gaming terminal. Some players are reluctant, however, to reveal their true identity to a gaming terminal or a casino. Further, the use of Personal Identification Numbers (PIN) is popular for identification, but people often forget their PINs. As used herein, information that establishes a player's true identity is information that is absolutely unique to a person (e.g., a social security number or a credit card number) or at least substantially unique to a person (e.g., a person's full legal name) such that, if the information is known, it can be used to identify the true identity of the person.

As such, there is a need to develop a player identification system where the true identity of the player remains anonymous. The present invention is directed to satisfying this need.

SUMMARY OF THE INVENTION

The present invention relates to a gaming system comprising a database, a controller, and at least one gaming terminal. The database stores a plurality of player-profile data sets. Each of the plurality of player-profile data sets is associated with and maintains anonymity of a respective player. The controller for the system is coupled to the database and to the gaming terminal. The gaming terminal includes an input device for receiving player-profile inputs from a player at the gaming terminal. The gaming terminal sends a player-profile signal to the controller. The player-profile signal contains information corresponding to the player-profile inputs for comparison to the plurality of player-profile data sets. Hence, a player can be identified in the system without his or her true identity being known. The system can then provide for personalized attributes to be presented to the gaming terminal, such as allowing the player to play certain types of wagering games that are restricted from access to the general public, displaying a certain aesthetic format that is pleasing to the player, providing some additional comfort to the play area, or broadcasting certain audio content that the player prefers.

In another embodiment, the present invention is a gaming terminal that is capable of playing a wagering game and includes at least one player-input device and one or more displays. The player-input device receives, at the choice of the player, player-profile inputs wherein the player's true identity remains anonymous or player-identity inputs wherein the player's true identity is known. The player-profile inputs and player-identity inputs provide information to the gaming terminal for determining personalized attributes for the player at the gaming terminal. The displays display a randomly selected outcome of the wagering game in response to the player inputting a wager amount at the gaming terminal. The displays can also display information associated with the personalized attributes. As such, in this embodiment, the player has the choice as to whether to identify himself or herself by his or her true identity, or whether to remain anonymous by entering a player profile.

The present invention can also be described as a method of operating a wagering game. The method includes conducting the wagering game at a gaming terminal, and receiving inputs from a player that relate to a profile of the player. The inputs exclude a true identity of the player. The method further includes comparing the player inputs with a plurality of player-profile data sets to match the player inputs with a particular player-profile data set. In response to this comparison yielding a matched player-profile data set, the method further includes activating one or more personalized attributes at the gaming terminal associated with the matched player-profile data set.

The above summary of the present invention is not intended to represent each embodiment, or every aspect, of the present invention. This is the purpose of the Figures and the detailed description which follow.

BRIEF DESCRIPTION OF THE DRAWINGS

The foregoing and other advantages of the invention will become apparent upon reading the following detailed description and upon reference to the drawings.

FIG. 2 illustrates a control system that is used in conjunction with the gaming terminal of FIG. 1.

FIG. 3 illustrates the displays of the gaming terminal in FIG. 1 in which the player is requested to enter a Player's Club Network by entering player information.

Figure 1:
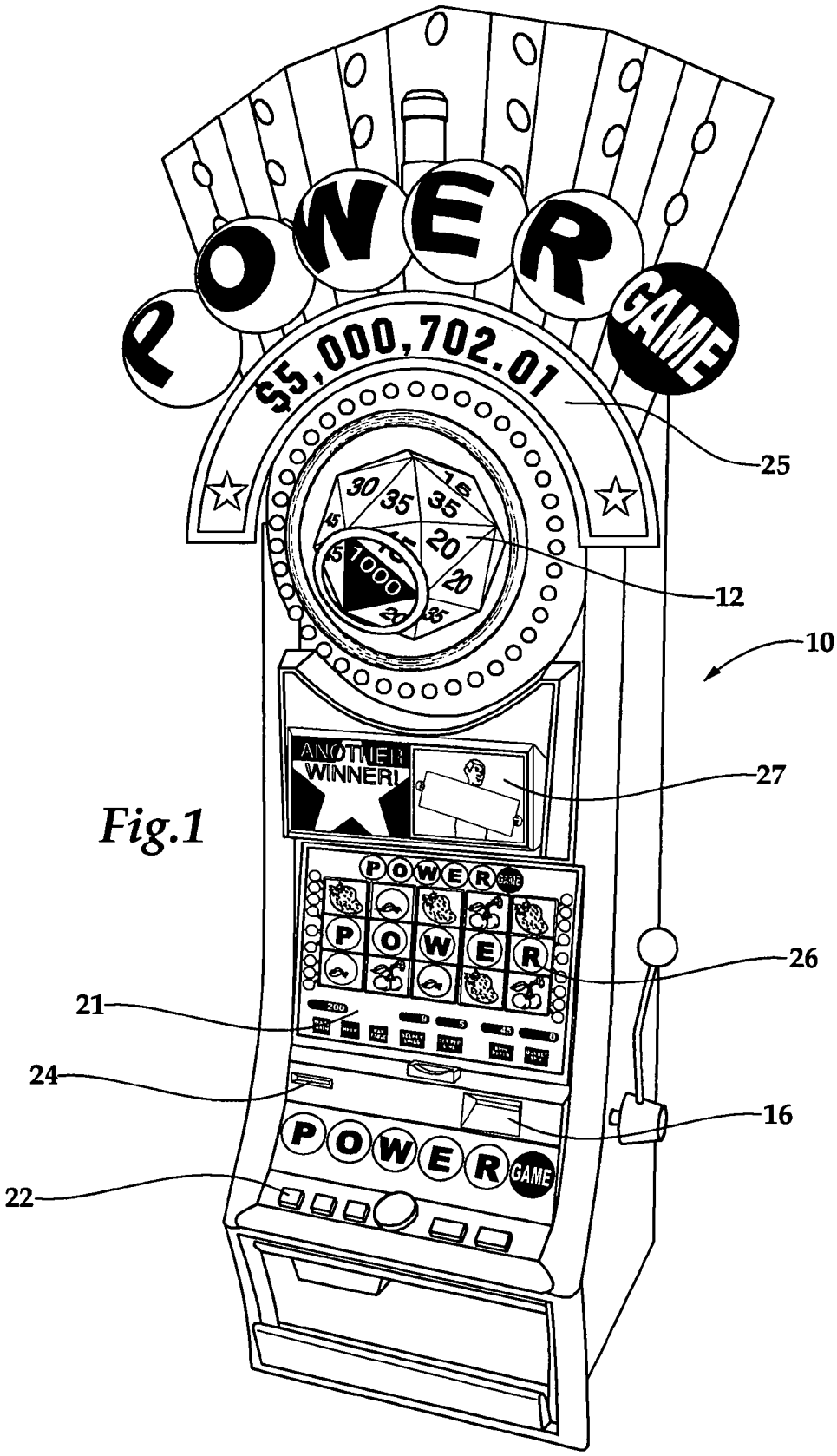
FIG. 1 illustrates a gaming terminal that is useful for operating the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a perspective view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play a video casino game such as blackjack, slots, keno, poker, etc.

As shown, the gaming terminal 10 has a top box including a rotating element 12 for playing a bonus game that may be played during or after the player has played the basic wagering game associated with the gaming terminal 10. The gaming terminal 10 includes input devices, such as a wager acceptor 16, a touch screen 21, a push-button panel 22, and a player-identification card reader 24. For outputs, the gaming terminal 10 includes a progressive game display 25 for displaying the value of a progressive game, a main display 26 for displaying information about the wagering game, and a secondary display 27 that can display game-related information or other entertainment features. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The wager acceptor 16 may include a coin slot acceptor or a note acceptor to input value to the gaming terminal 10. Or, the wager acceptor 16 may include a card-reading device for reading a card that has a recorded monetary value with which it is associated. The card may also authorize access to a central account, which can transfer money to the gaming terminal 10.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The operation of the basic wagering game is displayed to the player on the main display 26. The main display 26 may take the form of a cathode ray tube (CRT), a high resolution LCD, a plasma display, LED, or any other type of video display suitable for use in the gaming terminal 10. As shown, the main display 26 includes a touch screen 21 overlaying the entire monitor (or a portion thereof) to allow players to make game-related selections. Alternatively, the gaming terminal 10 may have a number of mechanical reels to display the game outcome.

The player-identification card reader 24 allows for the identification of a player by reading a card with information indicating his or her true identity. Currently, the identification is used by casinos for rewarding certain players with complimentary services or special offers. For example, a player may be enrolled in the gaming establishment's players club and may be awarded certain complimentary services as that player collects points in his or her player-tracking account. The player inserts his or her card into the player-identification card reader 24, which allows the casino's computers to register that player's play at the gaming terminal 10. The gaming terminal 10 may use the secondary display 27 for providing the player with information about his or her account or other player-specific information.

As shown in FIG. 2, the various components of the gaming terminal 10 are controlled by a central processing unit (CPU) 30 (such as a microprocessor or microcontroller). To provide the gaming functions, the CPU 30 executes a game program. The CPU 30 is also coupled to or includes a system memory 32. The system memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

As will be discussed in more detail below with respect to FIG. 7, the gaming terminal 10 is typically operated as part of a game control network 40 having control circuitry and memory devices, such as a network that controls the play of restricted-access progressive wagering games, as described in U.S. Patent Application No. 60/502,762, filed on Sep. 12, 2003, and entitled "Restricted Access Progressive Game For A Gaming Machine," which is commonly owned and herein incorporated by reference in its entirety. The game control network 40 can be other types of networks too. The gaming terminal 10 often has multiple serial ports, each port dedicated to providing data to a specific host computer system that performs a specific function (e.g., accounting, player-tracking, or a progressive game control system, etc). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 40). To perform this function, a Slot Machine Interface Board (SMIB) 38 is used by the gaming terminal 10. One SMIB 38 is typically present for each communication port in the gaming terminal 10. The SMIB 38 may poll the gaming terminal 10 for data, or the SMIB 38 may only listen for data being transmitted from the gaming terminal 10 as it is produced on an event-driven basis. This data is stored on the SMIB 38 and is accessible to the game control network 40 via the RS-485 side of the SMIB 38. It should be noted that the gaming terminal 10 can initially be designed to be configured for a typical RS-485 protocol, instead of the typical RS-232 protocol. Further, the gaming terminal 10 may simply be designed for an Ethernet connection, thereby eliminating the need for the SMIB 38.

FIG. 3 illustrates the displays 26 and 27 of the gaming terminal 10 in FIG. 1 in which the player is asked whether he or she would like to begin operation of the wagering game while being logged into the Player's Club Network, which, for the purposes of this specification, is a hypothetical club that can be associated with a casino, a group of casinos, or a manufacturer of gaming terminals. In short, the generically described Player's Club Network of FIG. 3 can be any one of a variety of networks that provides some type of advantage or incentive for the player that he or she finds desirable. The Player's Club Network, which is illustrated in FIG. 7, includes a controller and a database for establishing and using player-profile data sets, as will be discussed in detail relative to FIG. 7.

Via the touch screen 21 that overlays the display 26 of FIG. 3, the player can select "NO" and play the wagering game in the normal operational mode that is not connected to the network. Alternatively, the player can choose "INFO" to learn more about the Player's Club Network through information displayed on the display 26. Or, the player can choose "YES" and enter the Player's Club Network. If the player has chosen "YES" in FIG. 3, then the displays 26 and 27 provide information of the type shown in FIGS. 4A and 4B. This information allows for a player to enter specific types of information that, when taken together, form a "player profile."

Figure 4A:
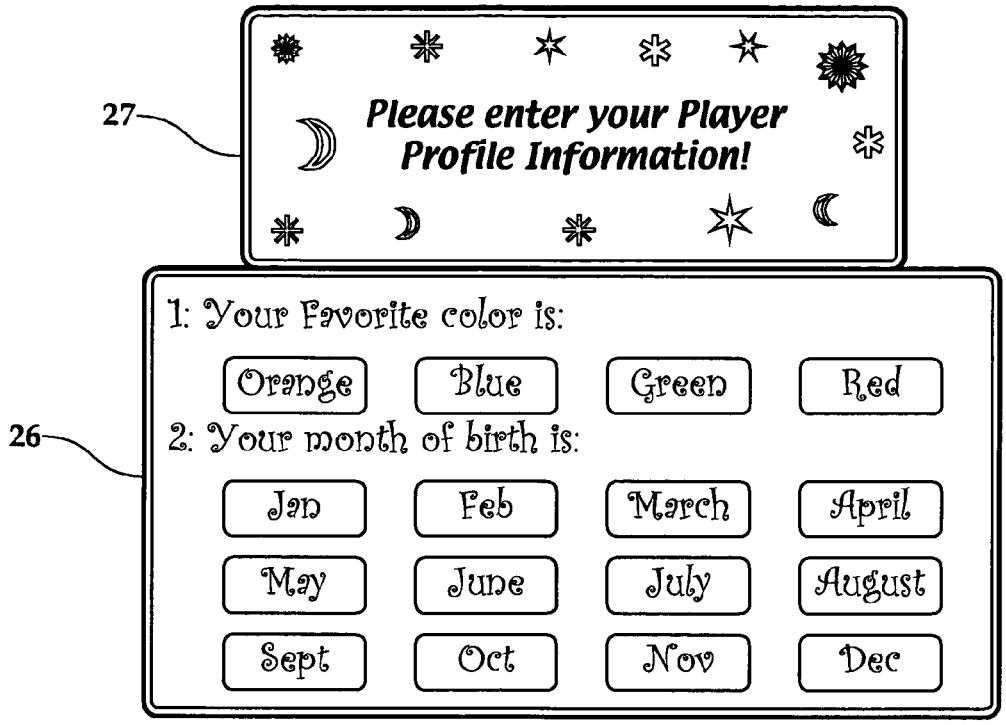
FIG. 4A illustrates a series of questions on the display of the gaming terminal in FIG. 1 that the player answers in the form of a multiple-choice entry.

In FIG. 4A, a player enters player-profile data through a multiple-choice formatted input. As shown in FIG. 4A, there are only two pieces of data (i.e., answers to two questions) that the player inputs through the touch screen on the display 26. As such, the gaming terminal 10 may be configured to display other screens having additional questions for receiving player-profile information after the player has adequately answered the first two questions set forth in FIG. 4A. Or, all the necessary questions can be placed on one screen of the display 26. When the multiple-choice formatted input is used, the number of multiple-choice answers can widely vary. For example, the "Favorite Color" question in FIG. 4A may have ten possible answers, instead of four.

Figure 4B:
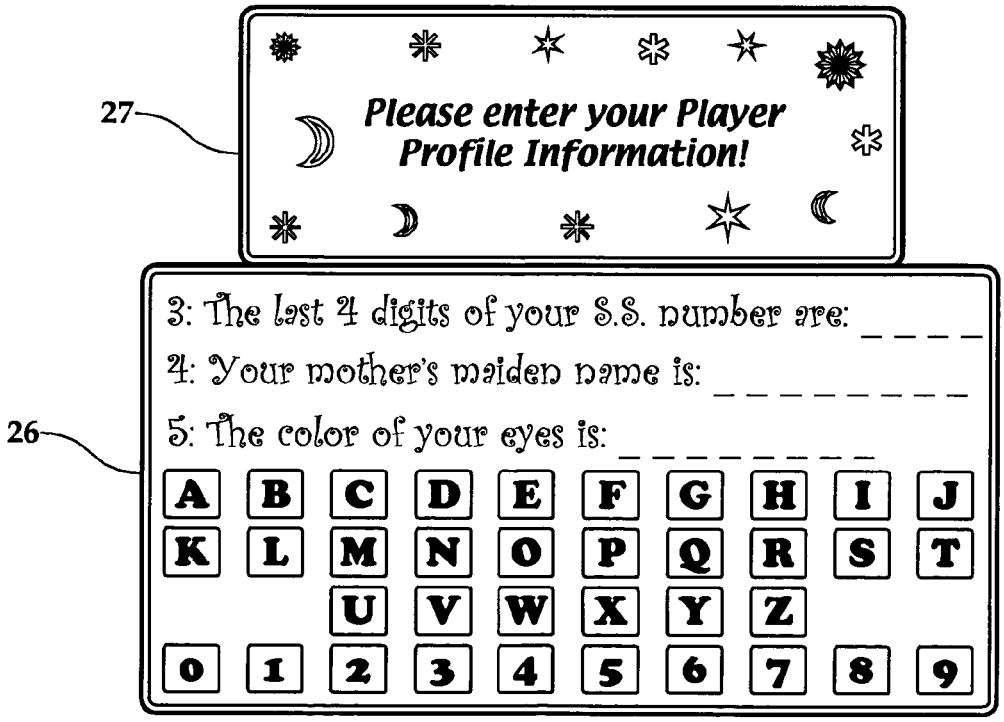
FIG. 4B illustrates a series of questions on the display of the gaming terminal in FIG. 1 that the player answers in the form of an alpha-numeric entry.

In FIG. 4B, a player enters player-profile information by inputting alpha-numeric data on blanks after the questions. To accommodate the entry of alpha-numeric information, the display 26 includes the letters of the alphabet and the digits 0 to 9, any of which can be activated via the touch screen that is placed over the display 26. As shown in FIG. 4B, the questions that are answered by the player are the follow-up questions (i.e., Nos. 3-5) displayed on the display 26 after the player has entered the information required by the questions (Nos. 1-2) on the display 26 of FIG. 4B. Thus, when a player enters his or her player-profile information, the gaming terminal 10 may require that she or he do so in the form of both an alphanumeric input and a multiple-choice input. Alternatively, the gaming terminal 10 may be configured to utilize only one type of these input formats.

From the information that is supplied in FIGS. 4A and 4B, the Player's Club Network can identify a player based on the unique inputs from that player. In other words, it is very unlikely that any two persons within a group of tens-of-thousands of players would answer questions 1-5 in FIGS. 4A and 4B identically. Obviously, the likelihood that any two persons would provide identical player-profile information is a function of the types of questions that are asked. Advantageously, the player can be identified without his or her true identity being known.

For example, the player inputs can include one or more of the player's "favorites," such as the player's favorite color, favorite number, favorite animal, favorite sports team, favorite musical artist, favorite book, or favorite pet's name. Or, the player inputs can include "numerical" data, such as digits from a player's social security number, digits from a phone number, digits from a credit card, and digits from an address. The player inputs may include "name" data, such as a first name, initials of a full name, a last name, certain letters of a first or last name, a parent's first name, a parent's middle name, and a mother's maiden name. Alternatively, the player inputs may include "birth" data, such as a month of birth, day of birth, year of birth, city of birth, and age. In yet another category, the player inputs can may include "physical characteristics", such as gender, shoe size, waist size, hat size, height, eye color, hair color, or weight. Of course, those skilled in the art will appreciate the wide variety of other data that could be used in developing a player profile.

From the vast array of data points that can be used to develop a player-profile data set, it should be noted that some of these data points are "static" in that they will not change. For example, the last 4 digits of a social security number and the place of birth will not change over time. On the other hand, some of these data points are "dynamic" in that they may change. For example, the player's weight, favorite book, or favorite spots team may change over time. For this reason, because it is not uncommon for a player to forget all of the needed information that comprise his or her player-profile data set, it is preferred that at least a few of the data points are static. If a player forgets his profile information, then the system can be set up to inquire whether the player has forgotten certain data. If so, the "static" data points will likely be remembered, and after the player enters these static data, the network controller (described in FIG. 7) can place the remaining "dynamic" data points in the form of multiple-choice questions where the selectable options include data points from stored player-profile data sets having matches for the "static" data points that were entered.

It should be noted that, while a minimum number of player profile data points (e.g., at least five) is initially stored as a player-profile data set, the player may not need to answer all five questions to be identified in the Player's Club Network. For example, a certain player's profile data may be so unique that the player only needs to enter two or three answers to the questions before he or she is recognized, and the personalized attributes associated with that particular player are effectuated at the gaming terminal 10.

Figure 5:
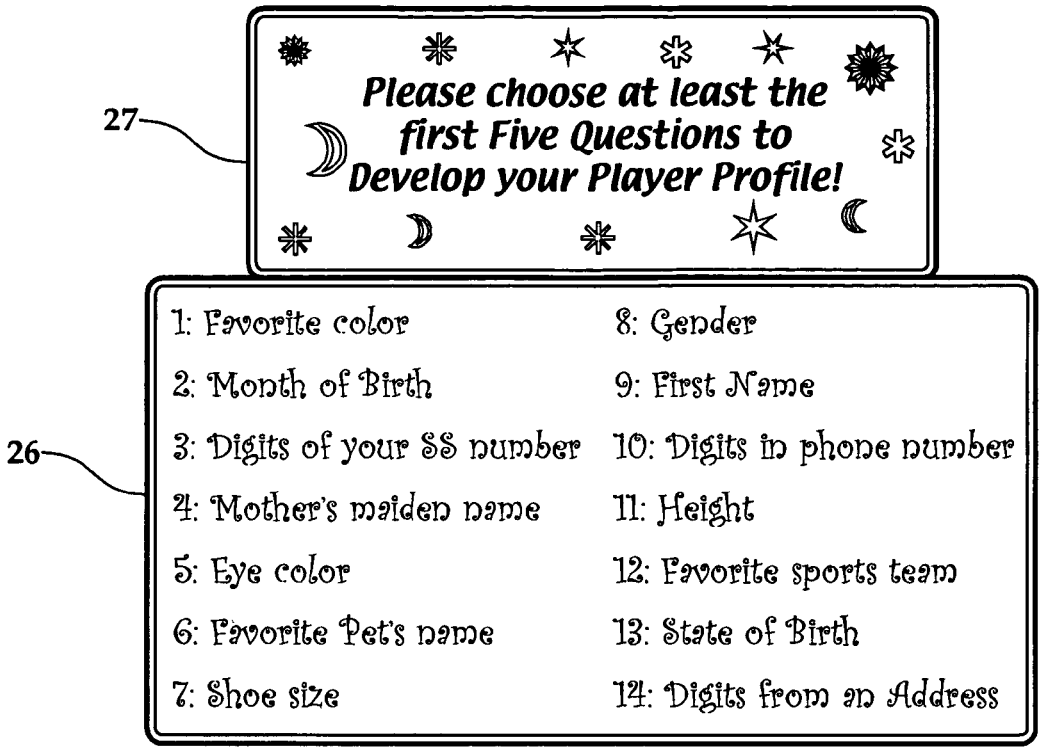
FIG. 5 illustrates the displays of the gaming terminal in FIG. 1 during the process by which the player initially develops his or her player profile for storage in a database.

FIG. 5 illustrates one method by which a player profile is initially created. To develop a player-profile data set that is stored in a database (as shown in FIG. 7), the player is prompted on the display 27 of the gaming terminal 10 to enter information responsive to at least the first five questions on the display 26, although the number of questions that is required to develop the player-profile data set can be any number that adequately develops a unique player-profile data set for a particular player. A player may choose to input information for all of the categories if he or she desires, which will lead to a higher probability that his or her particular player-profile data set will be unique. Alternatively, the gaming terminal 10 may instruct the player to answer all of the categories, even though only a few of the categories will be needed to ensure a unique player-profile data set. In another alternative, the player is instructed to answer a certain number (e.g., five) of categories, and the player decides which ones to choose.

As the popularity of the Player's Club Network increases and more players begin to initialize and develop their player-profile data set, more player-profile data from each player may be needed for differentiation. Accordingly, if the controller for the Player's Club Network determines that, based on increased number of player-profile data sets, more information is needed from the players, the next time each player seeks to enter his or her data, the gaming terminal 10 may instruct the player via the display 27 that categories 6 and 7 (i.e., favorite pet's name, and shoe size) must also be entered. On the other hand, if the player has already entered those first seven categories, the controller for the network (described more in FIG. 7) will not require the player to enter additional data. In other words, if the controller requires additional player-profile data from a particular player in order to allow that player to be differentiated from other players, the Player's Club Network may request additional information at a later point in time after the player has initially established his or her player profile. If differentiation between two players with the same profiles is needed, the player may be asked to reveal when his or her last login was (e.g., within the last 7 days, between 7 and 30 days ago, more than 30 days ago.)

Further, while FIG. 5 shows that a player can enter his or her player-profile information at the gaming terminal 10, the present invention contemplates a stand-alone terminal, such as a kiosk, within the gaming establishment (e.g., a casino) that performs this function. In a further alternative, the player can enter his or her information from any computer that is linked to the central database (e.g., via the Internet) which stores the player-profile data sets. In yet another alternative, personnel at the gaming establishment can manually enter the player-profile data into the Player's Club Network for the player.

Figure 6:
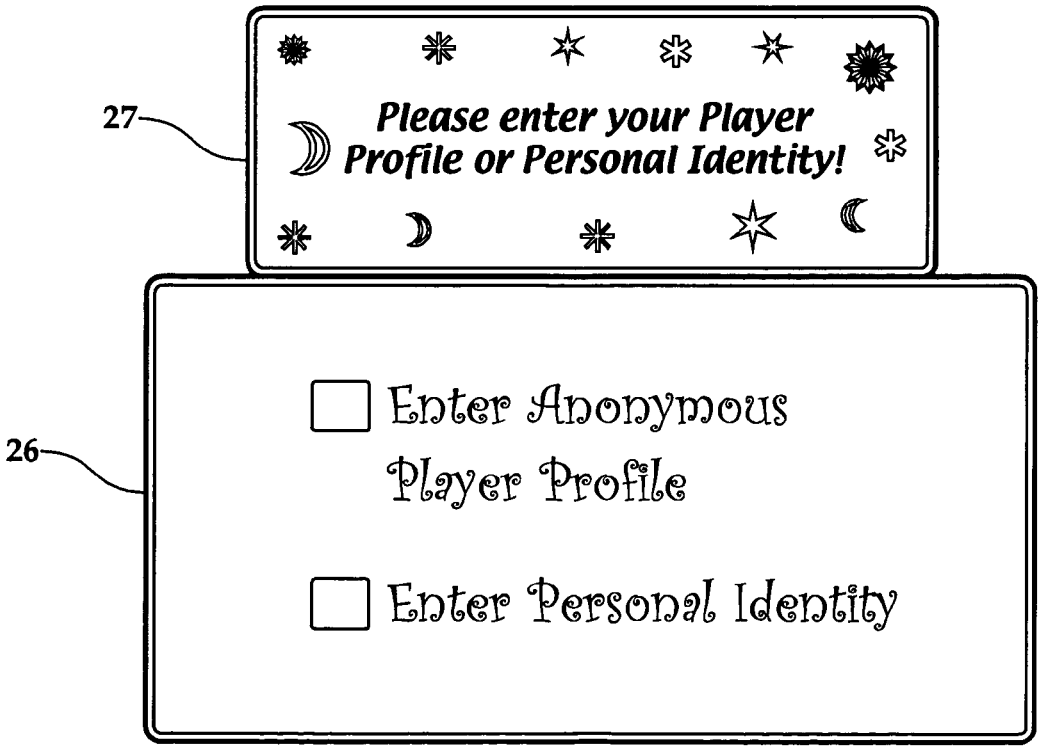
FIG. 6 illustrates the displays of the gaming terminal in FIG. 1 in which the player is requested to enter a restricted gaming network by entering player information in the form of a player profile so as to remain anonymous, or in the form of the player's true identity.

In FIG. 6, an alternative embodiment for the gaming terminal 10 is disclosed whereby the player can select the manner by which he or she identifies himself or herself at the gaming terminal 10. For example, a player may be indifferent as to whether his or her true identity is known and stored within the database. If that is the case, the player may enter information indicative of his or her true identity (e.g., via a card inserted into the card reader 24 of FIGS. 1 and 2, or an alphanumeric entry through an input such as the one shown in FIG. 4B) and, perhaps, a personal identification number or code to ensure authenticity. On the other hand, another player may choose to remain anonymous and provide a player-profile input, such as in the manner shown with respect to FIGS. 4A and 4B. In summary, FIG. 6 illustrates an embodiment whereby a player can determine whether he or she will be identified by his or her true identity, or remain anonymous when logging into the Player's Club Network.

Identifying a player without knowing his or her true identity can be used for providing that player with personalized attributes at the gaming terminal 10. These personalized attributes can take a variety of forms, such as providing a certain aesthetically pleasing format of the wagering game on the displays 26 and 27. In other words, the player might be able to alter certain attributes (e.g., background color, brightness, enhanced hardware, enhanced graphics, etc.) of the wagering game on the displays 26 and 27 and the gaming terminal 10 will automatically adjust the displays 26 and 27 to reflect the player's preferences after he or she has been recognized by his or her player-profile information. Similarly, a certain type of audio broadcast (e.g., type of music) or simple audio preferences (e.g., volume) can be automatically adjusted for the player after he or she has entered his or her player-profile information. As a further embodiment, the type of player-profile data (e.g., such as favorite color, favorite music), itself, can be used to help create an enhanced player experience as the gaming terminal 10 can adjust to have a certain color background or broadcast certain music. Thus, the integrated game features that a player prefers can be a part of the data that helps to identify the player.

After identifying a player by entering his or her player-profile information, the gaming terminal 10 can also adjust itself to be more comfortable for that particular player. For example, if an integrated, automatically adjustable seat is incorporated within the gaming terminal 10, then the player's preferred seat location can be adjusted. If the player prefers warm air to be circulated toward his or her feet, the fan for the internal cooling system for the gaming terminal 10 can be directed to send the warm air, produced by the heat from the electronics with the gaming terminal 10, to a duct leading to a vent adjacent the player's feet. Likewise, internal fans, which are simply for circulating ambient temperature air, can be controlled to force air toward the player for a cooling effect. Further examples and details of gaming terminals with personalized climate control are described in U.S. patent application Ser. No. 10/444,733, filed on May 22, 2003, and entitled "Gaming Machine with Personal Climate Control," which is commonly owned and herein incorporated by reference in its entirety. Another aspect of comfort may include displaying content in a larger font or displaying the content in a different language that is more pleasing to the player.

Alternatively, the personalized attributes may relate to the types of wagering games to be played, such as allowing the player to enter a restricted-access progressive game where only that player is eligible to win a progressive jackpot that is incremented over time based on that player's wagering. Or, the restricted-access progressive game may be only accessible to a group having a limited number of players. In the most fundamental embodiment of a group progressive game, every player in the group is eligible for the progressive jackpot and the progressive jackpot is incremented upwardly from the base value each time one of the players in the group inputs a wager on the basic wagering game associated with the gaming terminal 10. Details of restricted-access progressive games are described in U.S. Patent Application No. 60/502,762, filed on Sep. 12, 2003, and entitled "Restricted Access Progressive Game For A Gaming Machine," which is commonly owned and herein incorporated by reference in its entirety. In short, the gaming establishment can determine the types of data that are collected, and the personalized attributes that can be altered once the player has entered his or her player profile.

In any of these personalized attributes that have been described, it is assumed that, after the player initiates his or her player profile as shown in FIG. 5, the player will then input certain information to allow the gaming terminal 10 to learn the player's preferences. Hence, the player's personalized attributes can be stored along with the player's player-profile data set.

As with a gaming network that require players to enter their true identity, the present invention also can be used to record historical data for each player. Thus, the player can learn which gaming terminal 10 has resulted in he or she achieving the highest or lowest winnings because the database for the Player's Club Network can store this information along with the player's player-profile data set. Further, the gaming establishment and/or the gaming terminal manufacturer can gather useful information about the types of preferences that certain players have, which can have strategic importance when developing and designing new gaming terminals.

Also, it should be noted that the gaming terminal 10 can display information to confirm to the player that he or she has entered the correct profile data. The displays 26 or 27 can state, for example, "Welcome Chief" or "Welcome Big Daddy" after the player-profile data has been entered. Here, the nicknames of "Chief" and "Big Daddy" are entered by the player after he or she has initiated his or her player-profile data. Furthermore, the profile inputs can be also verified by a biometric input (e.g., voice verification, fingerprint verification, retinal scanning, etc.) from the player. Verification could be passive (e.g., face recognition) or active (e.g., requiring the player to touch a certain receptor).

Figure 7:
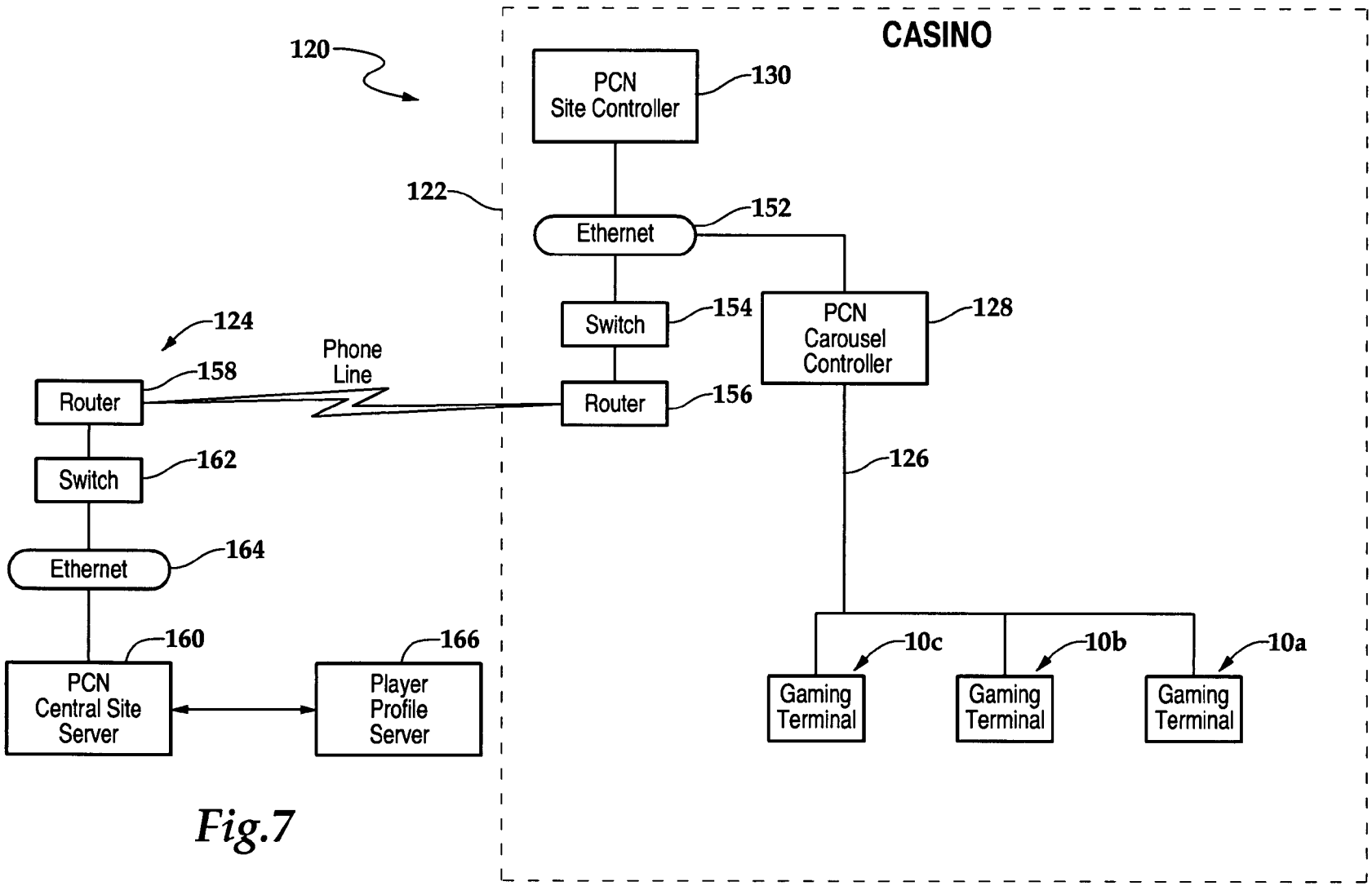
FIG. 7 illustrates a network for allowing the storage and use of player-profile data.

FIG. 7 illustrates one example of a Player's Club Network ("PCN") 120 that is useful for developing and operating a gaming system where players can be identified via player-profile inputs as described above. The PCN 120 includes components within a casino 122 and may include components at a remote location 124. Within the casino 122, a plurality of gaming terminals 10*a*, 10*b*, 10*c* (which can provide for a plurality of different wagering games) are connected through a multi-drop serial line 126 to a PCN carousel controller 128. The multi-drop serial line 126 may be, for example, an RS-485 serial data line, which is compatible with and linked to the SMIB 38 (FIG. 2) within the gaming terminals 10. A PCN site controller 130 is connected to the PCN carousel controller 128 through an ethernet connection 152. The plurality of gaming terminals 10*a*, 10*b*, 10*c* may also be connected to the network via a wireless connection, or through an Ethernet connection.

To link the PCN site controller 130 to the remote location 124, the casino 122 includes one or more switches 154 and routers 156. The router 156 within the casino 122 is connected through a phone line to a corresponding router 158 at the remote location 124. A PCN central site server 160 at the remote location 124 is coupled to the router 158 through a switch 162 and an ethernet connection 164. The PCN central site server 160 is connected to a player profile server 166 to allow for the exchange of player profile data and game data stored within the player profile server 166.

In operation, a player identifies himself or herself to the PCN 120 at the gaming terminal 10*a* by inputting a player profile (FIGS. 4A and 4B). The player's information is transmitted along the multi-drop serial line 126 and collected by the PCN carousel controller 128. As two of its functions, the PCN carousel controller 128 serves to quickly collect player-profile data from a plurality of gaming terminals 10*a*, 10*b*, 10*c* and to communicate information, to selected ones of the gaming terminals 10*a*, 10*b*, 10*c* where wagering games are being played.

The player-profile data is collected at the PCN site controller 130 and processed into a format for transmission to the PCN central site server 160 at the remote location 124. After transmission to the PCN central site server 160, the data is compared to existing data within the player-profile server 166. The identification of the player at the gaming terminal 10*a* (e.g., player 3567 of 10,000 possible players) occurs within the player-profile server 166 without the player's true identity being known. Further, the player-profile server 166 determines which, if any, personal attributes (e.g., access to a restricted-access progressive games, comfort settings, audio preferences, etc.) are associated with the identified player.

Information related to the player and the associated personal attributes that are stored in databases within the player-profile server 166 is then transmitted to the PCN site controller 130. Based on this information from the remote location 124, the PCN site controller 130, via the PCN carousel controller 128, communicates with the gaming terminal 10*a* where the player has entered his or her player-profile information.

After the player has completed the gaming session at the gaming terminal 10*a* (or on an ongoing basis), information concerning the game play is transmitted from the PCN site controller 130 to the PCN central site server 160. Accordingly, updated player information and game play information are stored within the player-profile server 166. If the player attends a casino different from the casino 122 at a future date and the other casino is linked to the PCN central site server 160, the player can continue playing with the updated data. In other words, the present invention contemplates that the PCN central site server 160 can be linked to various types of gaming terminals in several casinos so that players can access the network at several different casinos. In this embodiment, the PCN central site server 160 is important in situations in which a casino do not share player data with other casinos.

The PCN 120 in FIG. 7 is merely one example of many possible network architectures. Many other types of connections between the gaming terminals 10*a*, 10*b*, 10*c* and the PCN site controller 130 and between the PCN site controller 130 and the player tracking server 133 can be utilized. Further, the PCN 120 can be located entirely within the casino 122 and dedicated to only one casino 122, such that it performs all functions within the casino 122. In such an embodiment, all information regarding the player is stored locally in databases within the casino 122.

Thus far, the invention has been described as one in which a single player has a unique player-profile data set to trigger the gaming terminal 10 to effect personalized attributes for that player. However, it should be known that several players may purposefully have the same preferences and, thus, share the same unique player-profile data set. As one example, a group restricted-access progressive game was previously mentioned as a type of personalized attribute. In such an embodiment, each player in the group may use the same player-profile inputs to log into the group restricted-access progressive game. Or, players may enter a wagering "league" player profile to enter a league in which individuals compete against each other, or groups of individuals complete against each other. In addition to the interactivity that the player desires, entering a player profile dedicated to a group may yield additional benefits to players, thereby providing incentives to join a league.

While the present invention has been described with reference to one or more particular embodiments, those skilled in the art will recognize that many changes may be made thereto without departing from the spirit and scope of the present invention. For example, the skilled artisan will recognize that gaming that involves remote accessing and remote placing of wagers can utilize the present invention by allowing for a player to remain anonymous through player-profile inputs. Each of these embodiments and obvious variations thereof is contemplated as falling within the spirit and scope of the claimed invention, which is set forth in the following claims.

What is claimed is:

1. A method of operating a wagering game, comprising:

conducting said wagering game at a gaming terminal;

receiving inputs from a player that relate to a profile of the player, said inputs excluding a true identity of the player, wherein said true identity of the player is information that is absolutely unique to a person;

comparing said player inputs with a plurality of player-profile data sets to match said player inputs with a particular player-profile data set, said player-profile data sets including a plurality of player-chosen questions and player-chosen answers, said player-chosen questions selected by a player from a plurality of questions, and said player-chosen answers excluding said true identity of the player, said player-chosen answers each being an answer responsive to one of said plurality of player-chosen questions, and wherein the number of player-chosen questions is selected by a player; and in response to said comparing yielding a matched player-profile data set, activating one or more personalized attributes at said gaming terminal associated with said matched player-profile data set.

2. The method of claim 1, wherein said activating includes providing access to a restricted-access progressive wagering game.

3. The method of claim 1, further including receiving a physical characteristic to verify said player inputs correspond to the player.

4. The method of claim 1, wherein said player inputs include at least one of the group consisting of a favorite color, a favorite number, a favorite animal, a favorite sports team, a favorite musical artist, a favorite book, and a favorite pet's name.

5. The method of claim 1, wherein said player inputs include at least one of the group consisting of some, but not all, of the digits from a social security number, digits from a phone number, digits from a credit card, and digits from an address.

6. The method of claim 1, wherein said player inputs include at least one of the group consisting of a first name, initials of a full name, a last name, certain letters of a first or last name, a parent's first name, a parent's middle name, and a mother's maiden name.

7. The method of claim 1, wherein said player inputs include at least one of the group consisting of month of birth, day of birth, year of birth, city of birth, and age.

8. The method of claim 1, wherein said player inputs include at least one of the group consisting of gender, shoe size, waist size, hat size, height, eye color, hair color, and weight.

9. The method of claim 1, wherein said personalized attributes includes displaying information at said gaming terminal in the player's preferred language.

10. The method of claim 1, wherein said gaming terminal is located within a gaming establishment.

11. The method of claim 1, wherein said comparing occurs at a remote location relative to said receiving.

12. The method of claim 1, wherein said player inputs include inputs from two or more of the groups consisting of a favorites category, a numerical category, a name category, a birth category, and a physical-characteristic category.

13. A method of customizing a wagering game conducted at a gaming terminal, comprising:

acquiring set-up inputs from a player that relate to a profile of the player, said set-up inputs including a plurality of player-chosen questions and player-chosen answers, said player-chosen questions selected by said player from a plurality of questions, and said player-chosen answers maintaining anonymity of the player, said player-chosen answers each being an answer responsive to one of said plurality of player-chosen questions, and wherein the number of player-chosen questions is selected by said player;

based on said set-up inputs, developing a player-profile data set within a database, said player-profile data set maintaining anonymity of the player;

after said acquiring and said developing, receiving inputs from the player at said gaming terminal;

comparing said inputs with said player-profile data set in said database;

in response to said comparing yielding a match, providing the player with personalized attributes of said wagering game.

14. The method of claim 13, wherein said personalized attributes relate to wagering games that are accessible by the player.

15. The method of claim 13, wherein said personalized attributes relate to aesthetics or comfort of said gaming terminal.

16. The method of claim 13, wherein said personalized attributes relate to progressive wagering games that are accessible by the player.

17. The method of claim 13, wherein said personalized attributes relate to audio preferences for sound being broadcast from said gaming terminal.

18. The method of claim 13, wherein said acquiring set-up inputs occurs at said gaming terminal.

19. The method of claim 13, wherein said acquiring set-up inputs occurs at a remote terminal dedicated to receiving player inputs.

20. The method of claim 13, wherein said acquiring set-up inputs occurs via the Internet.

21. The method of claim 13, wherein said set-up inputs and said inputs include at least one of the group consisting of a favorite color, a favorite number, a favorite animal, a favorite sports team, a favorite musical artist, a favorite book, and a favorite pet's name.

22. The method of claim 13, wherein said set-up inputs and said inputs include at least one of the group consisting of some, but not all, of the digits from a social security number, digits from a phone number, digits from a credit card, and digits from an address.

23. The method of claim 13, wherein said set-up inputs and said inputs include at least one of the group consisting of a first name, initials of a full name, a last name, certain letters of a first or last name, a parent's first name, a parent's middle name, and a mother's maiden name.

24. The method of claim 13, wherein said set-up inputs and said inputs include at least one of the group consisting of month of birth, day of birth, year of birth, city of birth, and age.

25. The method of claim 13, wherein said set-up inputs and said inputs include at least one of the group consisting of gender, shoe size, waist size, hat size, height, eye color, hair color, and weight.

26. The method of claim 13, wherein said personalized attributes include aesthetics related to said inputs.

27. The method of claim 26, wherein said input is a favorite color and said personalized attributes include changing a background color of a display of said gaming terminal to said favorite color.

28. The method of claim 13, wherein said comparing occurs at a remote location relative to said receiving and said acquiring.

29. The method of claim 13, wherein said set-up inputs and said inputs include inputs from two or more of the groups consisting of a favorites category, a numerical category, a name category, a birth category, and a physical-characteristic category.

30. The method of claim 13, wherein said acquiring set-up inputs includes acquiring alphanumeric inputs from the player in response to a predetermined set of questions.

31. The method of claim 13, wherein said receiving inputs includes receiving alphanumeric inputs from the player.

32. The method of claim 13, wherein said receiving inputs includes receiving multiple-choice inputs from the player.

33. A gaming system, comprising:

a database storing a plurality of player-profile data sets, each of said plurality of player-profile data sets being associated with and maintaining anonymity of a respective player, said player-profile data sets further including a plurality of player-chosen questions and player-chosen answers, said player-chosen questions selected by a player from a plurality of questions, and said player-chosen answers excluding said true identify of the player, said player-chosen answers each being an answer responsive to one of said plurality of player-chosen questions, and wherein the number of player-chosen questions is selected by a player;

a controller coupled to said database; and at least one wagering gaming terminal coupled to said controller, said gaming terminal including an input device for receiving player-profile inputs from a player at said wagering gaming terminal, said wagering gaming terminal sending a player-profile signal to said controller, said player-profile signal containing information corresponding to said player-profile inputs for comparison to said plurality of player-profile data sets;

wherein said wagering gaming terminal activates one or more personalized attributes associated with a matched player profile input with one or of said plurality of player-profile data sets.

34. The gaming system of claim 33, wherein said database includes a second plurality of non-anonymous player-identification data sets identifying other players by their true identity.

35. The gaming system of claim 33, wherein said database and said at least one gaming terminal are located within a gaming establishment.

36. The gaming system of claim 33, wherein said database is remotely located from said at least one gaming terminal.

37. The gaming system of claim 33, wherein said at least one gaming terminal includes a plurality of gaming terminals for playing a plurality of different wagering games.

38. The gaming system of claim 33, wherein said database and said controller are remotely located from said at least one gaming terminal.

39. The gaming system of claim 33, wherein said player-profile inputs include inputs from two or more of the groups consisting of a favorites category, a numerical category, a name category, a birth category, and a physical-characteristic category.

40. A gaming terminal capable of playing a wagering game, comprising:

at least one player-input device receiving, at the choice of a player, player-profile inputs wherein the player's true identity remains anonymous or player-identity inputs wherein the player's true identity is known, said player-profile inputs and said player-identity inputs providing information to said gaming terminal for determining personalized attributes for the player at said gaming terminal;

said player-profile inputs wherein the player's true identity remains anonymous including a plurality of player-chosen questions and player-chosen answers, said player-chosen questions selected by said player from a plurality of questions, and said player-chosen answers maintaining anonymity of the player, said player-chosen answers each being an answer responsive to one of said plurality of player-chosen questions, and wherein the number of player-chosen questions is selected by said player; and one or more displays for displaying a randomly selected outcome of said wagering game in response to the player inputting a wager amount at said gaming terminal, said one or more displays displaying information associated with said personalized attributes.

41. The gaming terminal of claim 40, wherein said personalized attributes provide access to a restricted-access progressive wagering game.

42. The gaming terminal of claim 40, wherein said player-profile inputs include inputs from two or more of the groups consisting of a favorites category, a numerical category, a name category, a birth category, and a physical-characteristic category.

43. The gaming terminal of claim 40, wherein said player-identity inputs include a card that is inserted into and read by a card reader within said gaming terminal.

44. The gaming terminal of claim 40, wherein said randomly selected outcome is determined by a controller located remotely from said gaming terminal.

45. The gaming terminal of claim 40, wherein said personalized attributes relate to aesthetics or comfort of said gaming terminal.

46. The gaming terminal of claim 40, wherein said randomly selected outcome is determined by a controller located within said gaming terminal.

47. A kiosk for entering information for playing wagering games at gaming terminals connected via a network, comprising:

at least one player-input device receiving, at the choice of a player, player-profile inputs wherein the player's true identity remains anonymous or player-identity inputs wherein the player's true identity is known, said player-profile inputs and player-identity inputs providing information for determining personalized attributes for the player playing said wagering games at said gaming terminals;

wherein said player-profile inputs wherein the player's true identity remains anonymous including a plurality of player-chosen questions and player-chosen answers, said player-chosen questions selected by said player from a plurality of questions, and said player-chosen answers maintaining anonymity of the player, said player-chosen answers each being an answer responsive to one of said plurality of player-chosen questions, and wherein the number of player-chosen questions is selected by said player;

a display for displaying an inquiry regarding entry of said player-identity inputs and said player-profile inputs; and a connection for communicating data corresponding to said player-identity inputs and said player-profile inputs from said kiosk to a database in said network.

48. The kiosk of claim 47, wherein said player-profile inputs include inputs from two or more of the groups consisting of a favorites category, a numerical category, a name category, a birth category, and a physical-characteristic category.

* * * * *